US009690247B1

(12) United States Patent
LeFevre et al.

(10) Patent No.: US 9,690,247 B1
(45) Date of Patent: Jun. 27, 2017

(54) DECURLER INDENTING SHAFT INK-RELEASE COATING FOR INCREASED MEDIA LATITUDE

(71) Applicant: Xerox Corporation, Norwalk, CT (US)

(72) Inventors: Jason M. LeFevre, Penfield, NY (US); Santokh S. Badesha, Pittsford, NY (US); David A. VanKouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/066,036

(22) Filed: Mar. 10, 2016

(51) Int. Cl.
*G03G 15/00* (2006.01)
*B41J 11/00* (2006.01)

(52) U.S. Cl.
CPC ..... *G03G 15/6576* (2013.01); *B41J 11/0005* (2013.01)

(58) Field of Classification Search
CPC ..... G03G 15/6576; G03G 15/6573; G03G 2215/00662; B41J 11/0005
See application file for complete search history.

(56) References Cited

U.S. PATENT DOCUMENTS 3,607,343 A 9/1971 Longo et al.
4,704,776 A * 11/1987 Watanabe ..... D21F 3/08 492/54
5,066,984 A 11/1991 Coombs
5,519,481 A * 5/1996 Kuo ..... G03G 15/6576 162/271
5,707,326 A 1/1998 Hyllberg
5,848,347 A 12/1998 Kuo et al.
5,997,456 A 12/1999 Butters et al.
6,327,456 B1 * 12/2001 Higaya ..... G03G 15/2064 219/619
6,394,944 B1 5/2002 Hyllberg et al.
6,432,031 B1 8/2002 Paasonen et al.
7,809,323 B2 10/2010 Johnston et al.
8,052,590 B2 11/2011 Edmunds et al.
2004/0200418 A1 10/2004 Hartig
2009/0023567 A1 * 1/2009 Johner ..... B41F 13/08 492/52
2013/0010041 A1 * 1/2013 Roof ..... B41J 11/002 347/102
2015/0003883 A1 * 1/2015 Honda ..... G03G 15/6529 399/406

* cited by examiner

*Primary Examiner* — David Banh
(74) *Attorney, Agent, or Firm* — Gibb & Riley, LLC

(57) ABSTRACT

Printers include (among other components) a sheet path transporting printable media and a printing engine positioned within the sheet path. The printing engine prints markings on the printable media. A first roller is positioned within the sheet path, and the first roller has a harder outer surface. A second roller is positioned parallel to the first roller within the sheet path. The second roller has a softer outer surface relative to the harder outer surface. The first roller and the second roller form a decurling nip decurling sheets that have exited the printing engine. The harder outer surface comprises stainless steel having a metal plasma coating.

20 Claims, 2 Drawing Sheets

DECURLER INDENTING SHAFT INK-RELEASE COATING FOR INCREASED MEDIA LATITUDE

BACKGROUND

Systems and methods herein generally relate to printers, and more particularly to printing devices that utilize decurlers.

The commercial inkjet printing (drop-on-demand) industry continues to be an area of growth, as printers and printing equipment manufacturers realize the value of personalized digital content. Companies engaging in the inkjet business look to increase overall ink and media latitude in their ink jet printing machines, particularly if their systems use nipped rolling surfaces.

For example, decurlers are used to reduce the amount of down-curl in the sheet prior to delivering the sheet to the stacker. Down-curl can be induced on the printed sheet by the image (particularly when a solid stripe of ink is printed on the lead-edge of a sheet). The indenting shaft in one decurler can be used to generate up-curl, and can be used to counter-act the down-curl that is induced by the printed image in an aqueous ink-jet marking engine. This function is a useful feature, particularly when the printed sheet is delivered to an in-line stacker, which has an input spec (limit) for curl.

Some printers develop ink buildup when operating under some paper and ink loading conditions. If ink buildup occurs on the indenting shaft of the decurler, this can cause sheet wrinkle in the decurler. Such excessive ink buildup in the decurler may mandate a service call (as often as every 10K prints) which is an unacceptable level of maintenance. In addition to the ink contamination on the decurler roller, the ink that is deposited onto decurler roller can then be re-deposited onto blank areas of the printed sheet, creating an unacceptable "ink offset" print defect.

SUMMARY

Exemplary printers herein include (among other components) a sheet path transporting printable media and a printing engine positioned within the sheet path. The printing engine prints markings on the printable media. A first roller is positioned within the sheet path, and the first roller has a harder outer surface. A second roller is positioned parallel to the first roller within the sheet path. The second roller has an outer surface (e.g., rubber, polymer, and/or plastic) that is softer relative to the harder outer surface of the first roller. The first roller and the second roller form a decurling nip decurling sheets that have exited the printing engine.

The harder outer surface comprises stainless steel having a metal plasma coating. For example, the metal plasma coating can have a thickness of 0.075 mm-0.83 mm, a surface texture (roughness, average (Ra)) of less than 200 microns, a hardness measure of less than 70 Rockwell scale C (HRC), and a coefficient of friction of $0.1\mu_s$-$0.9\mu_s$.

Exemplary printing system can also use the above decurler, and such systems include (among other components) a sheet feeder transporting printable media, a printer receiving the printable media from the sheet feeder. The printer prints markings on the printable media. The first roller is positioned adjacent an exit of the printer. Again, the first roller has a harder outer surface, and the second roller is position parallel to the first roller adjacent the exit of the printer. The second roller again has a softer outer surface relative to the harder outer surface of the first roller. The first roller and the second roller form a decurling nip that decurls sheets that have exited the printer. The harder outer surface of the first roller comprises stainless steel having a metal plasma coating.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, ink buildup that occurs on the indenting shaft of the decurler can cause sheet wrinkle and may mandate an unusually early service call. Further, ink that is deposited onto decurler roller can then be re-deposited onto blank areas of the printed sheet, creating an unacceptable "ink offset" print defect.

Therefore, through the use of a coating on a decurler roller, the devices herein provide a noticeable increase in the ink limit which can be allowed, especially for papers which are a stress case for ink contamination and offset. This enables some ink jet treated papers to be printed using higher ink loading, and provides an associated color gamut increase. This also provides a level of protection for the machine operator, if they run an ink loading which is somewhat higher than recommended (based on image quality (IQ) ink limiting) for a particular paper. The structures herein also provide additional benefits by reducing decurler contamination (and/or ink offset) for cases where the decurler shaft indents an additional amount exceeding a nip (NVM=0). Further, such structures reduce and/or eliminate the need for a machine service call to clean the decurler.

Figure 1:
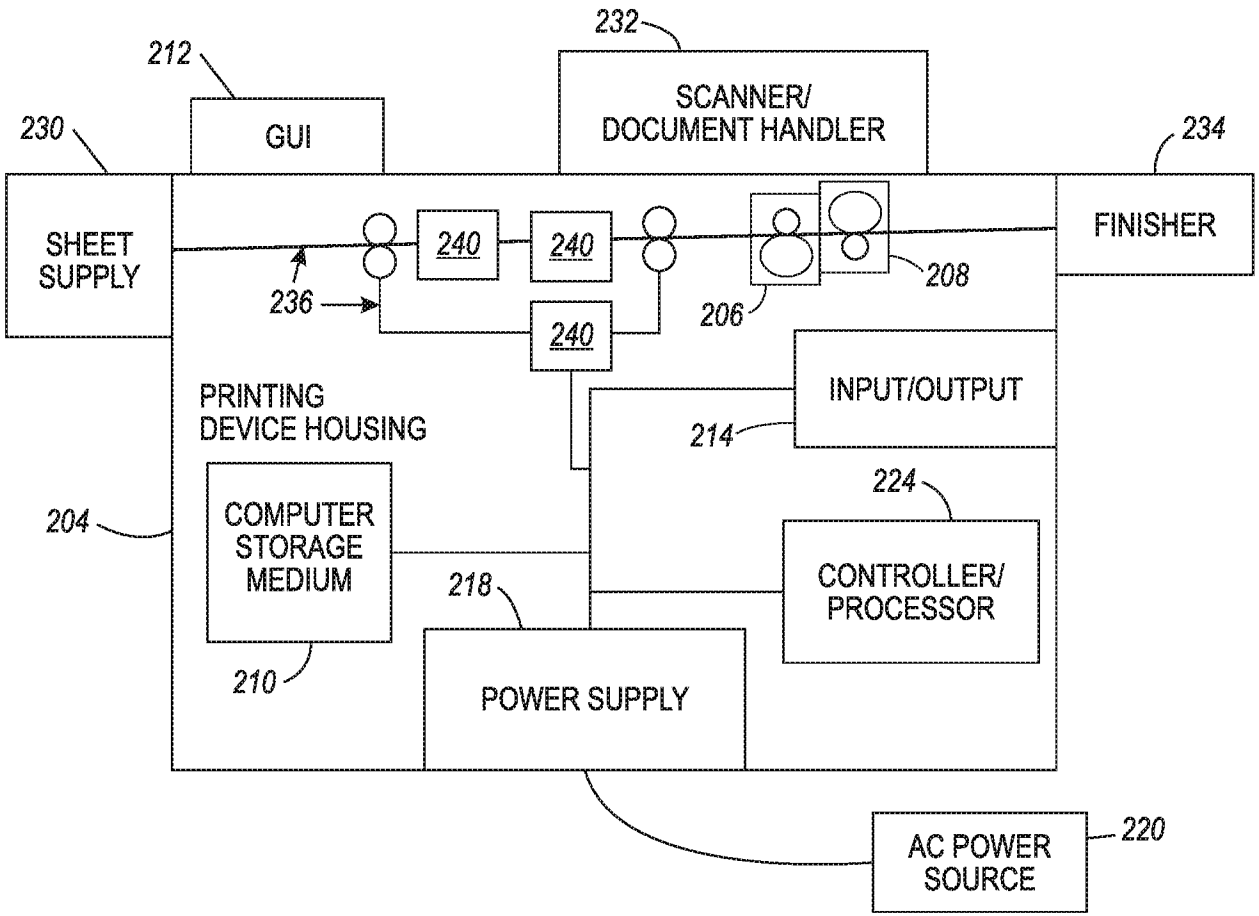
FIG. 1 is a schematic diagram illustrating devices herein.

FIG. 1 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 1, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 that use marking material, and are operatively connected to a specialized image processor 224 (that is different than a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

Figure 2:
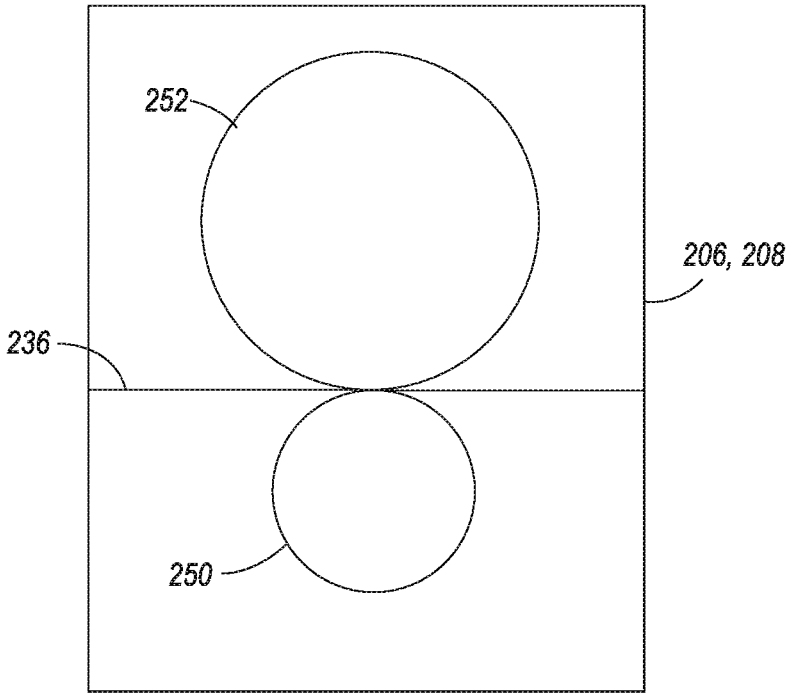
FIG. 2 is a schematic diagram illustrating devices herein.

Different decurlers 206, 208 are also illustrated in FIG. 1. Such decurlers can selectively impart relatively opposite curl to the sheets traveling along the sheet path 236, to cause the resulting output sheets to be flat. More specifically, as shown in FIG. 2, each decurler 206, 208 can include a first roller 250 that is positioned within the sheet path 236, and the first roller 250 has a harder outer surface. A second roller 252 is positioned parallel to the first roller 250 within the sheet path 236. The second roller 252 has a larger diameter than the first curler 250, and has an outer surface (e.g., rubber, polymer, and/or plastic) that is softer relative to the harder outer surface of the first roller 250. The relatively harder first roller 250 pushes the sheets into the relatively softer second roller 252 to impart or remove curl from the sheets. The first roller 250 and the second roller 252 thus form a decurling nip that decurls sheets that have exited the printing engine 250.

Figure 3:
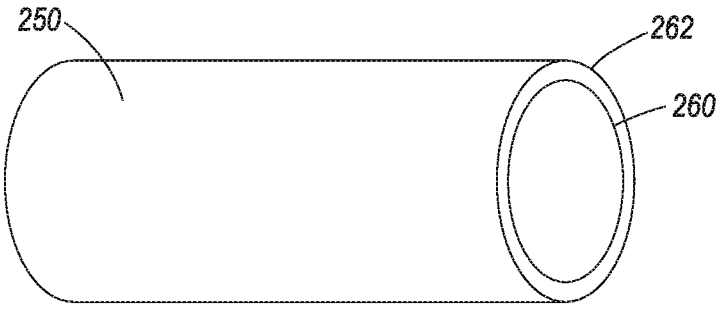
FIG. 3 is a schematic diagram illustrating devices herein.

As shown in FIG. 3, the harder outer surface 260 of the first roller 250 comprises stainless steel having a coating 262, such as a plasma coatings of nickel chrome, aluminum, tungsten carbide, ceramic, molybdenum, stainless steel, chromium carbide, bronze, brass, zinc, and alloys thereof including, for example, cobalt based alloys of complex carbides, etc. For example, the plasma coating 262 can include polymers and can have a thickness of 0.075 mm-0.83 mm, a surface texture (roughness, average (Ra)) of less than 200 microns, a hardness measure of less than 70 Rockwell scale C (HRC), and a coefficient of friction of $0.1\mu_k$-$0.9\mu_k$.

For purposes herein, Ra is the average roughness measured in microns (μm). More specifically, Ra is the arithmetic average of the absolute values of the profile height deviations from the mean line, recorded within the evaluation length. In other words, Ra is the average of a set of individual measurements of a surfaces peaks and valleys. With respect to $R_c$ or HRC, this represents the Rockwell scale that is a hardness scale based on indentation hardness of a material. The Rockwell test determines the hardness by measuring the depth of penetration of an indenter under a large load compared to the penetration made by a preload. There are different scales, denoted by a single letter (e.g., C) that use different loads or indenters. The result is a dimensionless number noted as HRA, HRB, HRC, etc., where the last letter is the respective Rockwell scale.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A decurling apparatus comprising:

first roller having a harder outer surface; and a second roller positioned parallel to said first roller and having a softer outer surface relative to said harder outer surface, said first roller and said second roller form a decurling nip, and said harder outer surface comprises stainless steel having a metal plasma coating.

2. The decurling apparatus according to claim 1, said metal plasma coating has a thickness of 0.075 mm-0.13 mm.

3. The decurling apparatus according to claim 1, said metal plasma coating has a surface texture (roughness, average (Ra)) of less than 200 microns.

4. The decurling apparatus according to claim 1, said metal plasma coating has a hardness measure of less than 70 Rockwell scale C (HRC).

5. The decurling apparatus according to claim 1, said metal plasma coating comprises one of nickel chrome, aluminum, tungsten carbide, ceramic, molybdenum, stainless steel, chromium carbide, bronze, brass, zinc, and alloys thereof.

6. The decurling apparatus according to claim 1, said second roller comprises at least one of rubber, polymer, and plastic.

7. The decurling apparatus according to claim 1, said first roller has a smaller diameter than said second roller.

8. A printer comprising:

a sheet path transporting printable media;

a printing engine positioned within said sheet path, said printing engine prints markings on said printable media;

first roller positioned within said sheet path, said first roller has a harder outer surface; and a second roller positioned parallel to said first roller within said sheet path, said second roller has a softer outer surface relative to said harder outer surface, said first roller and said second roller form a decurling nip decurling sheets that have exited said printing engine, and said harder outer surface comprises stainless steel having a metal plasma coating.

9. The printer according to claim 8, said metal plasma coating has a thickness of 0.075 mm-0.83 mm.

10. The printer according to claim 8, said metal plasma coating has a surface texture (roughness, average (Ra)) of less than 200 microns.

11. The printer according to claim 8, said metal plasma coating has a hardness measure of less than 70 Rockwell scale C (HRC).

12. The printer according to claim 8, said metal plasma coating comprises one of nickel chrome, aluminum, tungsten carbide, ceramic, molybdenum, stainless steel, chromium carbide, bronze, brass, zinc, and alloys thereof.

13. The printer according to claim 8, said second roller comprises at least one of rubber, polymer, and plastic.

14. The printer according to claim 8, said first roller has a smaller diameter than said second roller.

15. A printing system comprising:

a sheet feeder transporting printable media;

a printer receiving said printable media from said sheet feeder, said printer prints markings on said printable media;

first roller positioned adjacent an exit of said printer, said first roller has a harder outer surface; and a second roller positioned parallel to said first roller adjacent said exit of said printer, said second roller has a softer outer surface relative to said harder outer surface, said first roller and said second roller form a decurling nip decurling sheets that have exited said printer, and said harder outer surface comprises stainless steel having a metal plasma coating.

16. The printing system according to claim 15, said metal plasma coating has a thickness of 0.075 mm-0.153 mm.

17. The printing system according to claim 15, said metal plasma coating has a surface texture (roughness, average (Ra)) of less than 200 microns.

18. The printing system according to claim 15, said metal plasma coating has a hardness measure of less than 70 Rockwell scale C (HRC).

19. The printing system according to claim 15, said metal plasma coating comprises one of nickel chrome, aluminum, tungsten carbide, ceramic, molybdenum, stainless steel, chromium carbide, bronze, brass, zinc, and alloys thereof.

20. The printing system according to claim 15, said second roller comprises at least one of rubber, polymer, and plastic.

* * * * *